US005752443A

United States Patent [19]

Dawley

[11] Patent Number: 5,752,443

[45] Date of Patent: May 19, 1998

[54] MECHANISM FOR EXCLUDING CRITICAL SPEEDS FROM NORMAL OPERATING RANGES

[75] Inventor: Douglas J. Dawley, Epping, N.H.

[73] Assignees: Heidelberger Druckmaschinen AG, Heidelberg, Germany; Heidelberg Harris, Inc., Dover, N.H.

[21] Appl. No.: 491,540

[22] Filed: Jun. 16, 1995

[51] Int. Cl.[6] ..... B41F 5/00

[52] U.S. Cl. ..... 101/216; 101/181; 101/248

[58] Field of Search ..... 101/153, 183, 101/216, 181, 178, 483, 180, 220, 228, 211, 248; 73/650

[56] References Cited

U.S. PATENT DOCUMENTS

| | | | |
|---|---|---|---|
| 2,647,965 | 8/1953 | Michie | 73/650 |
| 2,724,289 | 11/1955 | Wight | 74/625 |
| 3,606,800 | 9/1971 | Treff et al. | 74/405 |
| 3,703,863 | 11/1972 | Giuiuzza | 101/183 |
| 3,742,849 | 7/1973 | Greiner et al. | 101/220 |
| 3,834,181 | 9/1974 | Strasburg et al. | 64/1 |
| 3,934,459 | 1/1976 | Wolfinger et al. | 73/650 |
| 4,724,763 | 2/1988 | Bolza-Schünemann et al. | 101/426 |
| 4,753,168 | 6/1988 | Theilacker et al. | 101/177 |

FOREIGN PATENT DOCUMENTS

| | | |
|---|---|---|
| 1199175 | 7/1970 | United Kingdom . |
| 1275628 | 5/1972 | United Kingdom . |
| 2071274 | 9/1981 | United Kingdom . |
| 2138538 | 10/1984 | United Kingdom . |

*Primary Examiner*—Christopher A. Bennett
*Attorney, Agent, or Firm*—Kenyon & Kenyon

[57] ABSTRACT

A mechanism to exclude critical speeds from normal operating ranges is provided having at least one drive unit to drive at least one unit of a processing machine. The at least one unit of a processing machine has a known torsional stiffness. A single power transmission is provided linking said at least one drive unit to said at least one unit of a processing machine. Said power transmission includes an adjustment member coupling to tune all torsional critical speeds out of the range of normal operating speeds of the processing machine. A single power transmission unit can therefore be used for an entire family of processing machines, wherein each processing machine may have a different stiffness.

23 Claims, 8 Drawing Sheets

MECHANISM FOR EXCLUDING CRITICAL SPEEDS FROM NORMAL OPERATING RANGES

FIELD OF THE INVENTION

The present invention relates to a mechanism for excluding critical speeds from normal operating ranges, particularly from the operating ranges of a rotary printing press.

BACKGROUND OF THE INVENTION

U.S. Pat. No. 2,724,289 purportedly discloses a coupling apparatus in which spur gears are maintained in engagement. When the torque is reduced below a predetermined value, the apparatus operates to ensure the engagement of the associated spur gears.

U.S. Pat. No. 3,606,800 purportedly discloses a printing press drive. The drive includes a worm gear connected to a source of power. The worm gear transmits power to another gear meshing therewith. The drive further includes a clutch mounted on one end of a cylinder shaft. The clutch limits the torque transmitted to the printing unit cylinder in order to prevent the printing press from being damaged by excessive torque, such as that which develops when a paper jam occurs. The clutch described therein is preferably used within a perfecting sheet-fed printing press. A further disconnecting arrangement for multi-unit printing presses is purportedly disclosed in U.S. Pat. No. 3,703,863.

U.S. Pat. No. 3,742,849 purportedly discloses a coupling arrangement for a perfecting lithographic press unit. A web is simultaneously printed on both sides by passing between a pair of blanket cylinders. The blanket cylinders are coupled together by gears to keep them operating at exactly the same peripheral speed under running conditions. To allow for individual phase adjustments when the press is running, a clutch is interposed between the gears of the blanket cylinders.

U.S. Pat. No. 4,753,168 purportedly shows a rotary offset printing machine with a clutch cylinder arrangement. An upper blanket cylinder/plate cylinder couple and a lower blanket cylinder/plate cylinder couple are selectively connected by two clutches to a main rotary drive. A third clutch is associated with the shaft of the upper blanket cylinder. By means of this coupling arrangement, double-prime-printing, prime-and-versoprinting or printing plate exchange can be performed during the printing operation.

The clutch arrangements outlined above do not satisfactorily solve the technical problems addressed below because they do not exclude critical speeds from the normal operating ranges of the press system. A critical speed is a speed at which a natural frequency of an apparatus is exited. Natural frequencies, in turn, are determined by the magnitudes and arrangement of the springs and inertias of the press system. Therefore, methods of clutching, phasing, or limiting torque fail to address critical speeds because they fail to address the springs or inertias of the press system.

SUMMARY OF THE INVENTION

In accordance with the present invention, a mechanism for excluding critical speeds from normal operating ranges of a processing machine includes at least one drive unit to drive at least one processing machine unit, the processing machine unit having a predetermined torsional stiffness, a single power transmission system linking the drive unit to the processing machine unit, the single power transmission system having an adjustment member coupling to tune all torsionally critical speeds out of the operating ranges of a family of machines.

The adjustment member coupling of the single power transmission system includes an adjustment member which may be adjustably mounted or may be replaceable. The adjustment member coupling includes, in addition to the adjustment member, driver members and driven members.

The power transmission system may further include line shafts arranged coaxially or gears, belts, or chains transmitting power to various machine segments. The adjustment member coupling lies in the primary torque path and the stiffness of the adjustment member coupling can be adjusted to provide more or less stiffness to the torque path. As one of ordinary skill in the art will appreciate, power for a printing press (or other processing machine) generally flows along a primary torque path, and if a component is removed from the primary torque path, subsequent components within the torque path will no longer rotate.

Each component in the primary torque path can be represented as a spring having a rotational inertia (inch-lbs.-sec.) and a torsional stiffness (inch-lbs/rad). By making the adjustment member couplings more compliant (e.g., less stiff) than the other components (represented as springs) in the torque path, they will be dominant in determining the press system's critical speeds. This is because the total stiffness of a torque path is determined by adding the stiffnesses (e.g. inch-pounds/rad) of all the components (represented as springs) in series ($1/K_{tot}=1/K_1+1/K_1+\ldots$), and the critical speeds are directly related to the stiffness of the primary torque path. Therefore, by increasing or decreasing the stiffness of the adjustment member couplings, the critical speeds are raised or lowered into speed ranges outside of the normal operating ranges.

In accordance with a first embodiment of the present invention, the adjustment member coupling includes a double flexible coupling. In accordance with this embodiment, a torque tube (the adjustment member) connects a driver shaft to a driven shaft, and the stiffness of the adjustment member can be adjusted either by changing the axial distance between the driver shaft and the driven shaft, by replacing the torque tube with a torque tube having a different wall thickness, or by replacing the torque tube with a torque tube made of a material with a different stiffness.

In this manner, the stiffness of the adjustment member coupling can be adjusted in order to move the critical speeds of the press outside of the range of normal operating speeds of the press. As a result, by adjusting the adjustment member coupling, a single power transmission can be used for an entire family of printing presses.

In accordance with a second embodiment of the present invention, the adjustment member coupling includes a driver member having an elongated protrusion, a driven member, and replaceable spring members (the adjustment member). The elongated protrusion from the driver member is mounted within a corresponding opening in the driven member. The replaceable spring members are mounted within the opening, and adjacent to the elongated protrusion of the driver member. The replaceable spring member may be mounted within the opening by screws or other fastening devices. The replaceable spring members can easily be exchanged in order to change the stiffness of the adjustment member coupling and shift the critical speeds of the press outside of the range of normal operating speeds of the press. The stiffness of the replacement spring members can be determined by choosing material with a greater or lesser stiffness (elastic modulus). Moreover, the geometric configuration of the replaceable spring members can effect the stiffness, for example, by using a thicker configuration to increase stiffness.

In accordance with a third embodiment of the present invention, the adjustment member coupling includes a driver member having an elongated protrusion, a driven member, and a support member (the adjustment member). The elongated protrusion from a driver shaft is mounted within a corresponding first opening in the driven shaft. A sidewall separates the first opening from a second opening in the driven shaft. A support is replaceably mounted within the second opening of the driven member. By changing the shape, composition, or orientation of a support member, the stiffness of the adjustment member coupling is varied. Thus, the critical speeds are raised or lowered by only modifying the adjustment member coupling's stiffness in order to shift the critical speeds out of the range of normal operating speeds of the press.

DETAILED DESCRIPTION OF THE INVENTION

Figure 1:
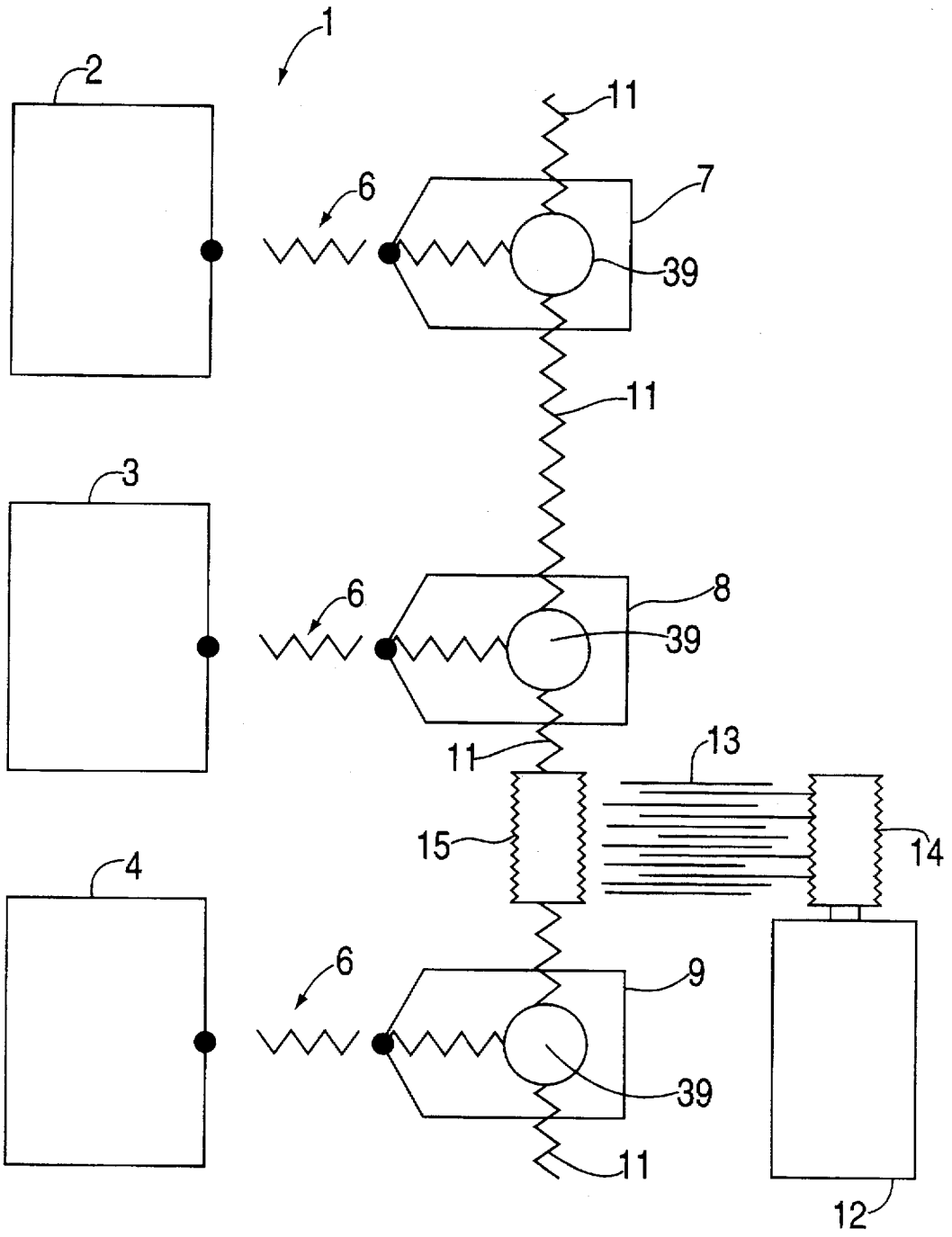
FIG. 1 is a schematic view of a printing press according to the present invention having a single power transmission system.

It is possible to design press systems with no unit-to-unit torsional critical speeds in or near the normal operating range. For example, critical speeds can be removed by either minimizing the number of rotational frequencies in the press-system power transmission or maximizing the press-system's stiffnesses, and minimizing inertias. By maximizing the press system's stiffnesses, the press system's torsional natural frequencies are raised as high as possible. A press system's stiffness can be increased by shorting springs, increasing sectional inertias, or choosing materials with a higher elastic modulus.

If a main drive's rotational frequency coincides with a torsional natural frequency of the press system, a resonant vibration can be excited. Large amplitude torsional motions within the press will cause both machine and printing problems, such as a doubling effect on one print. A doubling effect, for example, can result when one printing unit of a press vibrates relative to another printing unit of the press, or when a plate cylinder vibrates relative to its corresponding blanket cylinder. In both cases, the dot printed does not land exactly on top of the dot laid down by the previous printing unit. This results in a visible latent image or doubling.

Although it is possible design press systems with drives having no critical speeds in the normal range of operating speeds of the press, the resulting drive cannot generally be used on dissimilar machines without having critical speeds in the operating range because the natural frequencies of a machine is heavily influenced both by the geometry of the printing unit and the number of printing units. In other words, for a given unit-to-unit drive, a two-unit long-grain press has unit-to-unit torsional natural frequencies different from those of a four or six-unit press, all of which are very different from those of a short-grain press. Consequently, individual drives have been designed for each machine type with no attempt made to optimize for the number of units in a given machine.

Specifically, it is common for a given printing press to be available in a 4-unit or an 8-unit configuration; i.e., presses having four printing units and presses having eight printing units. If a drive were designed to be stiff enough to shift critical speeds outside of the normal operating range of the larger 8-unit configuration, it might nevertheless have critical speeds within the normal operating range of the smaller 4-unit configuration.

As an example, a heavy duty, 4:1 worm drive might be designed to drive an 8-Unit press configuration with a normal operating range of 2000–3000 fpm. In such a system, the first mode of vibration might be excited at 1000 fpm by the worm and at 4000 fpm by the worm gear, thereby ensuring that the critical speeds remained outside the normal operating range of the press.

However, if the same drive were used for such a press in a 4-unit press configuration, the decreased inertia of the 4-unit configuration might raise the two critical speeds to 2500 fpm and 10000 fpm, respectively. As a result, the critical speed resulting from the worm would fall squarely within the normal operating range of the press system making the 4:1 worm drive unacceptable Both the development and manufacturing costs of producing a large number of different drive designs are high. Moreover, the risk of operating at a torsional resonance has not necessarily been eliminated for a given machine. If a machine was found to have a critical speed driven print defect within the operating range, such as a doubling effect, a costly redesign and retrofit had to be undertaken.

These disadvantages are overcome in accordance with the present invention.

FIG. 1 shows a configuration of a printing press according to the present invention having a single power transmission system.

A printing press 1 having a first printing unit 2, a second printing unit 3 and a third printing unit 4 is driven by a main drive 12. To each of the first, second and third units 2, 3 and 4 a first in-unit-drive 7, a second in-unit-drive 8 and a third in-unit-drive 9 is assigned. These in-unit-drives 7, 8 and 9 all have an in-unit-drive inertia 39 of a specific known value. The first, second and third in-unit-drives 7, 8 and 9 are connected with each other by means of a single power transmission system 11 which, for example, may be a line shaft assembly. The single power transmission system 11 contains a main drive component 15 which is coupled to the main drive 12 via belts 13, gears 14 (or other conventional means). In this manner, the power of the main drive 12 is transmitted into the single power transmission system 11 via belts 13 and gears 14.

As set forth above, each of these components 2–4, 7–9, and 11–15, may be represented as a spring having an rotational inertia I (inch-lbs.-sec) and a torsional stiffness K (in-lbs./rad).

The open line shafts of the single power transmission system 11 on the first in-unit-drive 7 and the third in-unit-drive 9 symbolize that other assemblies easily can be connected to the configuration.

An adjustment member coupling 6, linking each of the units 2, 3 and 4 to a respective one of the in-unit-drives 7, 8 and 9, acts as a compliant spring in the primary torque path. The adjustment member coupling 6 will be dominant in determining the press torsional critical speeds because it is more compliant than other components (represented as springs) in the primary torque path. Increasing or decreasing the stiffness of the member 6 will raise or lower the critical speeds.

Referring to FIG. 1, the replacement or adjustment of adjustment member coupling 6 is symbolized by not connecting the spring line with any one of the units 2, 3, 4 or one of the in-unit-drives 7, 8, 9.

As one of skill in the art will appreciate, the rotational inertias and torsional stiffnesses of the in-unit-drives 7, 8, 9 and the first, second and third units 2, 3 and 4 are readily determinable. Specifically, the inertia and stiffness of each of the drives and units may be determined, based on the stiffness of each torque path, using any of the conventional mathematical modelling techniques presently used in the industry.

Since the stiffnesses of the in-unit-drives 7, 8, 9 and the first, second and third units 2, 3 and 4 are known and adjustment member coupling 6 in the power transmission system 11 is tunable, only modification of the adjustment member coupling 6 is required to shift the critical speeds out of the normal operating ranges.

Figure 2:
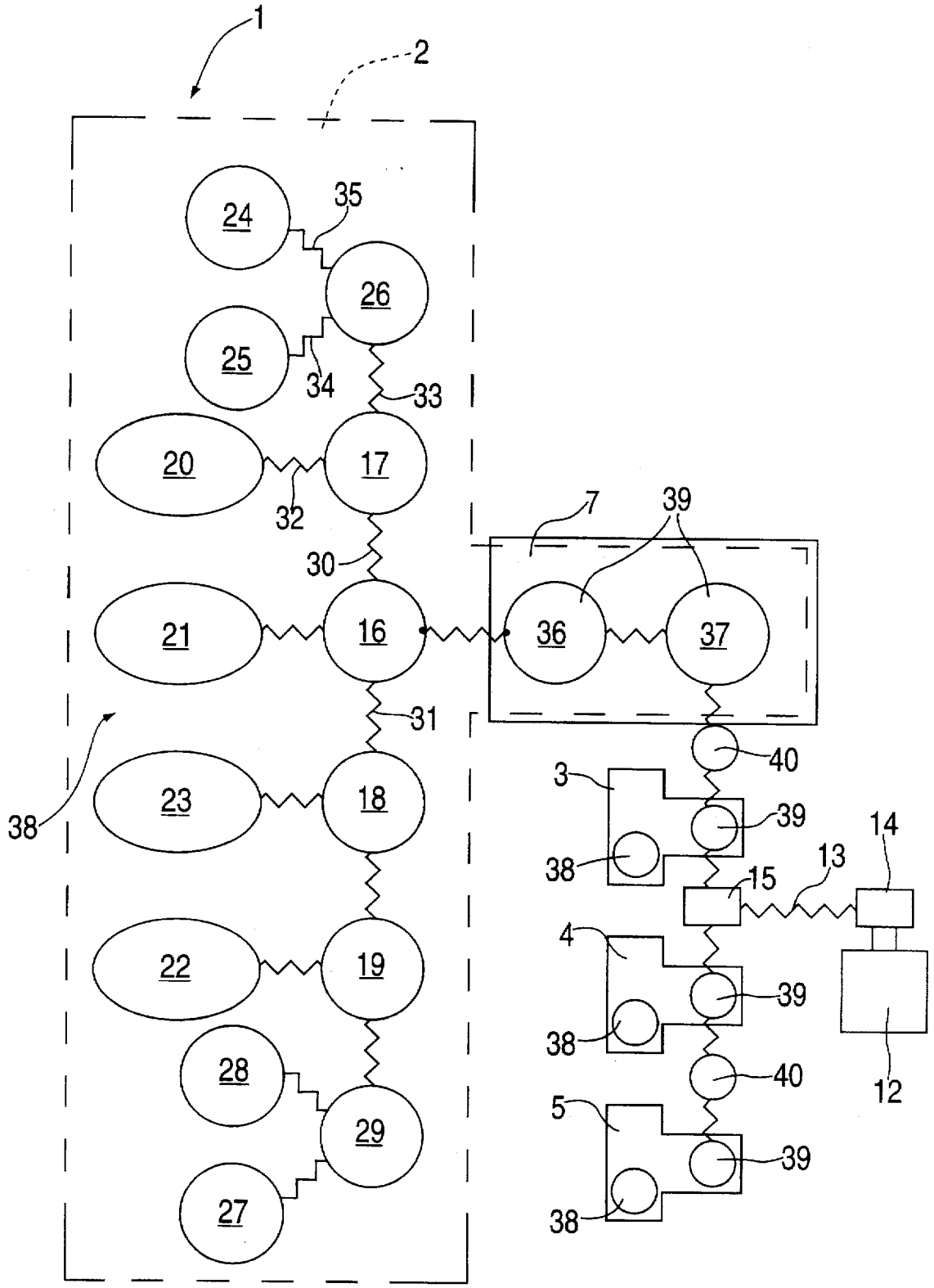
FIG. 2 is a mathematical model of a four-unit printing press system.

FIG. 2 shows a mathematical model of a four unit press system according to an embodiment of the present invention.

In order to predetermine the necessary stiffness of the most compliant spring, i.e. the adjustment member coupling 6, in the power transmission train, a first unit 2 of a processing machine 1 can be modelled according to FIG. 2 to calculate a unit's overall rotational inertia 38. The model can be expanded or simplified depending upon the degree of accuracy required.

The inertias chosen for the components are dictated largely by the product to be printed. The central drive gear assembly's inertia 16, the upper gear assembly's inertia 17 and the inertias of first and second lower gear assemblies 18 and 19 are taken into consideration. Associated with these gear assembly inertias are the inertias of the printing unit cylinders, i.e. the upper plate cylinder inertia 20, the upper blanket cylinder inertia 21, the lower plate cylinders inertia 22 and the lower blanket cylinders inertia 23. Furthermore, the inertias of an upper inker 24, an upper dampener 25 as well as those of a lower inker 27 and a lower dampener 28 are considered. The auxiliary inertias 26, 29 for clutch arrangements are also modeled.

Reference numeral 38 is representative of the overall unit's inertia, which comprises the above-mentioned component inertias. Therefore, reference numeral 38 is assigned to the second, third and fourth unit 2, 3 and 4 of the processing machine 1. The overall inertia 38 is provided only for ease of reference, and is not needed for the model itself.

The respective in-unit-drive 7 is also modelled accordingly. A common overall in-unit-drive inertia 39 is derived from a jack shaft inertia 36 and a line shaft inertia 37 in the case of a line shaft configuration.

In a similar manner the inertia of the springs connecting the above inertias are also calculated for input into the mathematical model.

Once the above inertias, and therefore the stiffness, are known, the power train of the power transmission system 11 can be engineered to make the unit-to-unit natural frequencies a strong function of only one spring's stiffness; i.e. the adjustment member coupling 6.

Since the drive coupling inertia 40 is also known, the power transmission system 11 can be engineered to be much stiffer than the adjustment member coupling 6 which is assigned to each unit, wherein the stiffness of the adjustment member is defined as $K_t$ (inch-pounds/rad). The stiffness of the adjustment member coupling 6 is then varied to move unit-to-unit natural frequencies to points where they will not be excited by rotational frequencies in the power transmission. Thus, it is possible to adjust only one member, the adjustment member coupling 6 of the single power transmission system 11, to shift critical speeds out of normal operating ranges.

Figure 3:
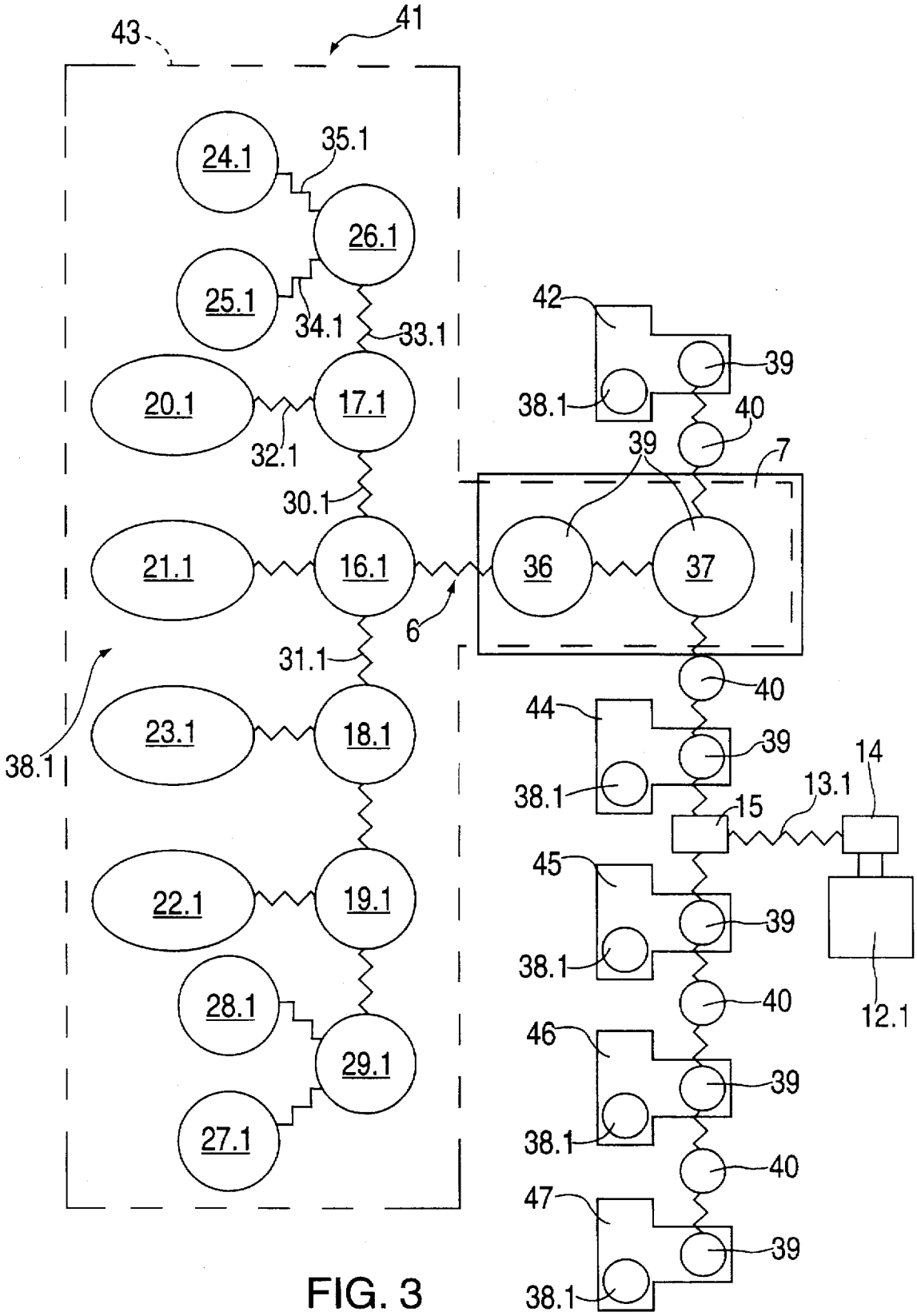
FIG. 3 is a mathematical model of a six-unit printing press system.

FIG. 3 shows a mathematical model of a six-unit short-grain press in accordance with another embodiment of the present invention. As with FIG. 3, this model can be expanded or simplified depending upon the degree of accuracy required.

A processing printing press 41 includes a first printing unit 42, a second printing unit 43, a third printing unit 44, a fourth printing unit 45, a fifth printing unit 46, and a sixth printing unit 47. Each of the printing units has a resulting unit inertia 38.1. Referring to FIG. 3, these resulting overall unit inertias 38.1 are obtained by modelling the respective units 42–47. A central drive gear inertia 16.1 is considered as well as an upper gear inertia 17.1 and a first lower gear inertia 18.1. Reference numeral 30.1 and 31.1 indicate the stiffness of gearings for an upper and a lower transmission respectively. Reference numeral 32.1 indicates an upper plate cylinder gearing stiffness, numerals 33.1, 34.1 and 35.1 indicate the stiffnesses of gearings of the coupling, dampener and inker. The printing unit cylinders' inertias are referenced by a "0.1" designation to indicate that they differ from the inertia recited in FIG. 1 concerning the first unit 2. Upper and lower dampener inertias 25.1, 28.1 as well as coupling inertias 26.1 and 29.1 also should be taken into consideration to get the resulting unit inertia 38.1.

The processing machine 41 is driven by a main drive 12.1. The main drive 12.1 does not necessarily have the same inertia as the drive 12 of FIG. 1. By a main drive pulley 14 and a belt arrangement 13.1, the torque is transmitted into a single power transmission system 11 containing drive assembly inertias 40. The belt arrangement may be replaced with gearing or other driving arrangements.

The power transmission system 11 and its respective drive assembly inertias 40, as well as the in-unit drive inertia 39, are the same as in the four-unit system of FIG. 2.

The power transmission system 11 connects the in-unit-drives assigned to each of the units 42, 43, 44, 45, 46 and 47. The in-unit-drives having an in-unit-drive inertia 39 transmit the torque to the units assigned via the adjustment member coupling 6.

Since the overall inertia 38.1 substantially differs from the overall inertia 38 of the four-unit system described in FIG. 2, the critical speeds of the six-unit system of FIG. 3 will differ substantially from the four-unit system of FIG. 2 given the same spring stiffnesses.

However, in accordance with the present invention, the critical speeds of each system can now easily be shifted by modifying the adjustment member coupling 6 which is the dominant spring in the primary torque path.

As a result, by adjusting the adjustment member coupling 6, a single power transmission becomes suitable to drive different printing press configurations within a family of presses, because modification of critical speeds is focused on only one adjustable or replaceable component.

Figure 4:
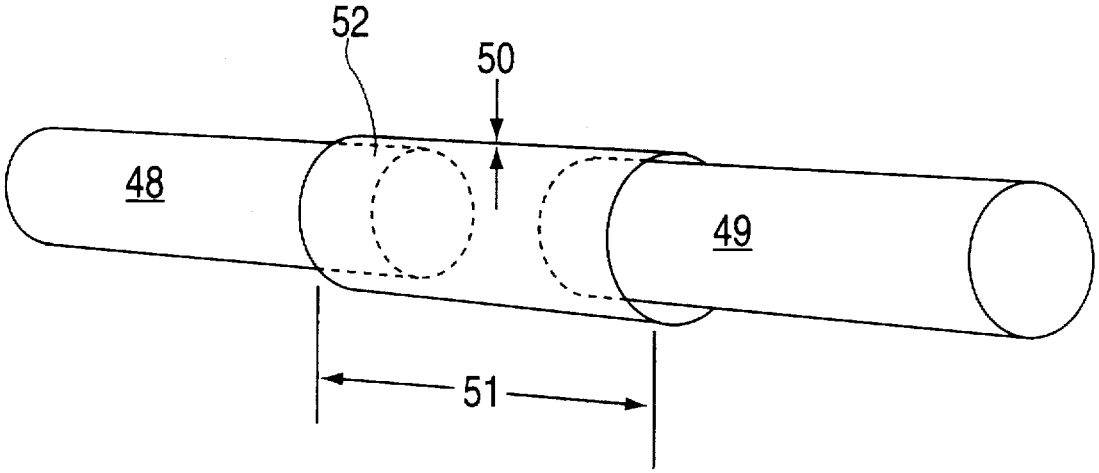
FIG. 4 shows an adjustment member coupling according to a first embodiment of the present invention including a double-flexible coupling.

FIG. 4 shows a first embodiment of the adjustment member coupling 6, wherein the adjustment member coupling 6 is formed as a double flexible coupling. A driver shaft 48 and a driven shaft 49 are connected by a torque tube 52. The torque tube 52 has a wall thickness 50 and may be made of any material capable of withstanding the torque which will be applied. Varying the stiffness of this adjustment member coupling 6 is either achieved by varying the material, i.e. exchanging the torque tube 52 with a torque tube having a different stiffness, by altering the thickness of the wall 50 (thereby changing the stiffness of the torque tube 52), or by changing the axial distance 51 between the driver shaft 48 and the driven shaft 49 (e.g. by axially moving shaft 48 relative to shaft 49 or vice versa). As such, the stiffness, $k_r$, of the adjustment member coupling 6 may be varied over a range of adjustable values.

Figure 5B:
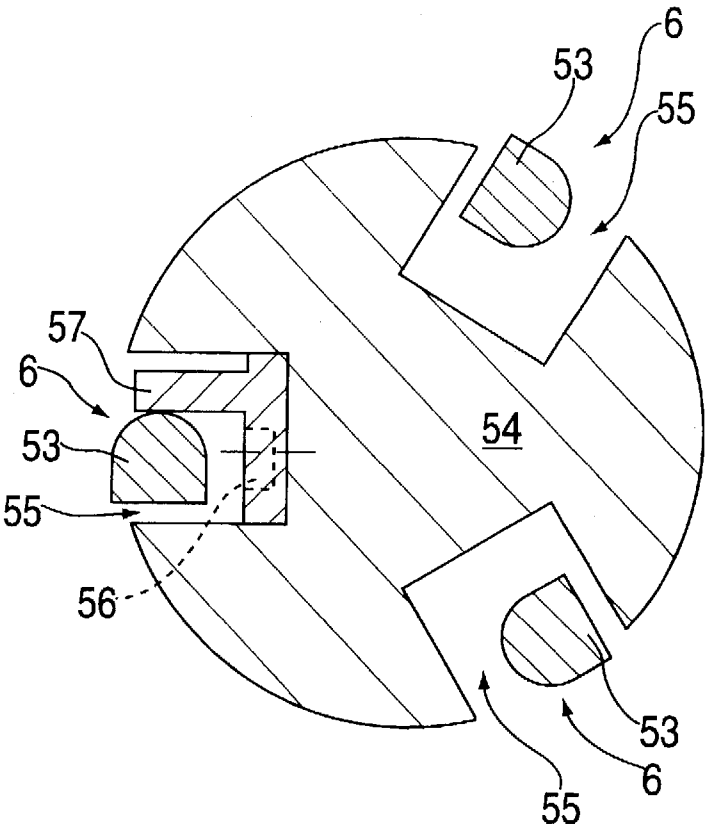
FIGS. 5(*a*) and 5(*b*) show an adjustment member coupling according to a second embodiment of the present invention including a replaceable spring member.
Figure 5A:
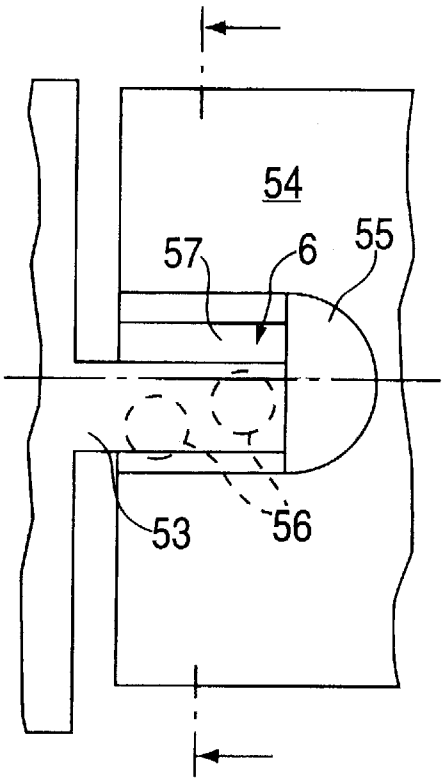

A second embodiment of the adjustment member coupling 6 is shown in FIG. 5. A driver shaft 53 has several protruding parts engaging spring members 57 mounted in grooves 55 of a driven shaft 54. Spring members 57 are mounted within the grooves 55 of the driven shaft 54 by means of screws 56, thereby allowing the spring members 57 to be easily replaced. Spring members 57 of different stiffness, e.g. different elastic moduli, can easily be mounted within the driven shaft 54, thereby changing the stiffness of the adjustment member coupling 6. In this manner the critical speeds can be increased or decreased by selecting appropriate spring members 57 so that the critical speeds lie outside the normal operating ranges of the press.

Figure 6A:
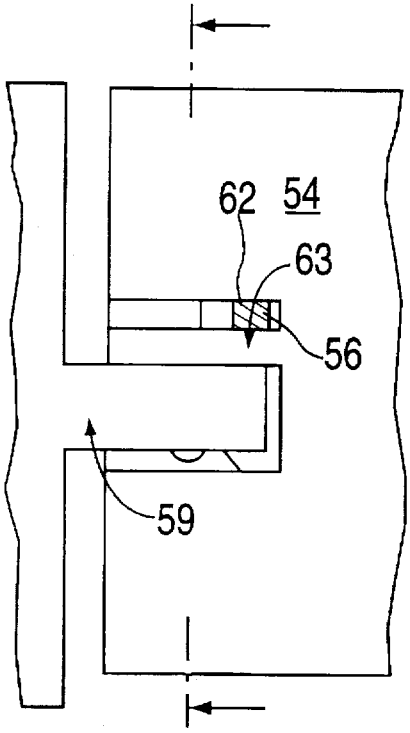
FIGS. 6(*a*) and 6(*b*) show an adjustment member coupling according to a third embodiment of the present invention including a replaceable support member.
Figure 6B:
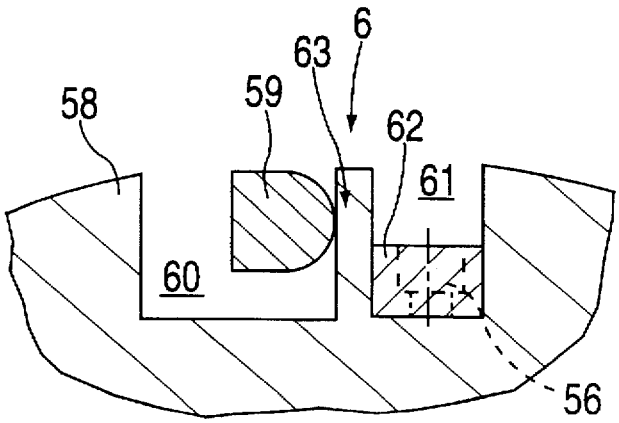
Figure 7A:
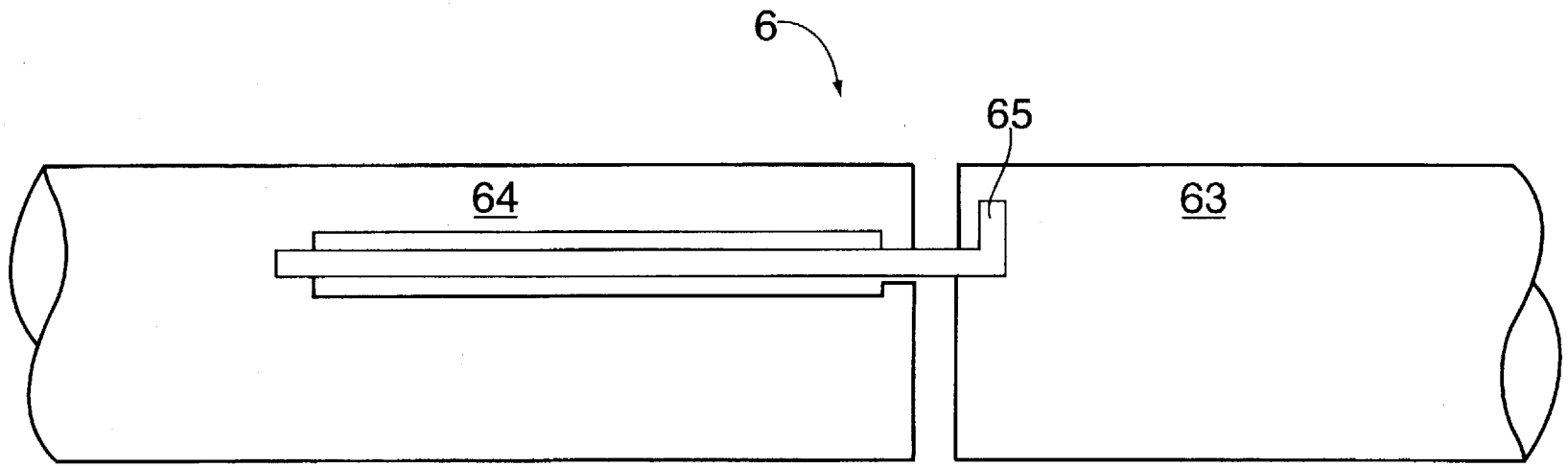
FIGS. 7(*a–d*) show an adjustment member coupling according to a fourth embodiment of the present invention including an rotatably mounted spring mechanism.
Figure 7B:
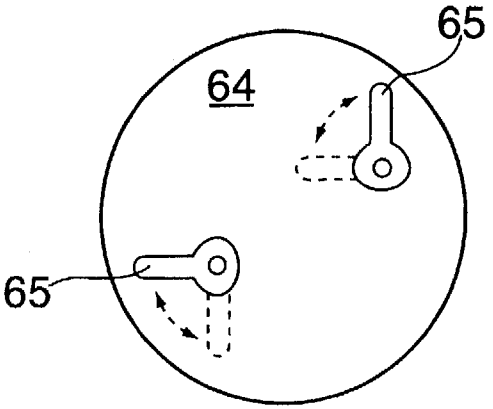
Figure 7D:
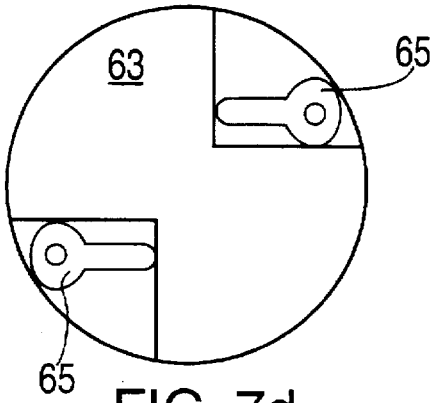
Figure 7C:
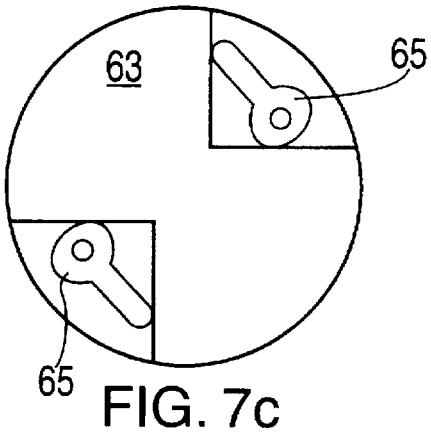

FIG. 6 shows a third embodiment of adjustment member coupling 6. In accordance with this embodiment, the stiffness of the adjustment member coupling 6 is altered by changing the stiffness, elastic modulus, geometry, or orientation of a support 62. The support 62 is mounted within a first groove 61 of a driven shaft 58. The driver shaft 59 abuts the driven shaft 58 on the side wall of a second groove 60. The support 62 is mounted by screws 56. The use of different materials, geometry, or orientation of support 62 changes the support provided to wall 63 of the driver shaft 59, and varies the stiffness of the adjustment member coupling 6.

FIGS. 7(*a–d*) show a fourth embodiment of the adjustment member coupling 6. By means of a rotatably mounted spring member 65 (e.g. a torsion bar) abutting a driver shaft 63, a range of spring stiffnesses between a driver shaft 63 and a driven shaft 64 can be obtained. Thus, the stiffness of the adjustment member coupling 6 can be influenced and, provided it is the dominant spring in the torque path, critical speeds can be shifted out of the normal operating range.

The driver shaft 63 has one or more recesses 630 for receiving a respective spring member 65, spring member 65 being mounted in the driven shaft 64. The spring member 65 can be mounted in the driven shaft 64 so as to occupy a range of angular positions. As illustrated in FIGS. 7(*b–d*), by varying the position of the spring member within the driven shaft 64, the position of the spring member relative to the driver shaft 63 is also varied. As the spring members 65 position relative to the driver shaft 63 is varied from a nearly radial position (FIG. 7(*c*)) to a tangential position (FIG. 7(*d*)), the stiffness of coupling 6 increases.

Referring to FIG. 7(*c*), the spring members 65 are shown in a nearly radial position relative to the driver shaft 63. The torque on the spring member 65 is defined as T=F*d, where "F" is the force applied to the spring member 65 by the driver shaft 63 and "d" is the moment arm of the spring member 65. In this position, the torque on the spring member 65 is at a maximum and the relative rotation of the driver shaft 63 and driven shaft 65 is at a maximum for a given transmitted torque. Therefore, the coupling 6 is at its softest.

Referring to FIG. 7(*d*), the spring members 65 are shown in a tangential position relative to the driver shaft 63. In this position, the moment arm "d" is zero, and the torque on the spring member 65 (T=F*d) is also zero. Therefore, the torque on the spring member 65 is at a minimum and the relative rotation of the driver shaft 63 and driven shaft 65 is at a minimum for a given transmitted torque. Therefore, the coupling 6 is at its stiffest.

Figure 8A:
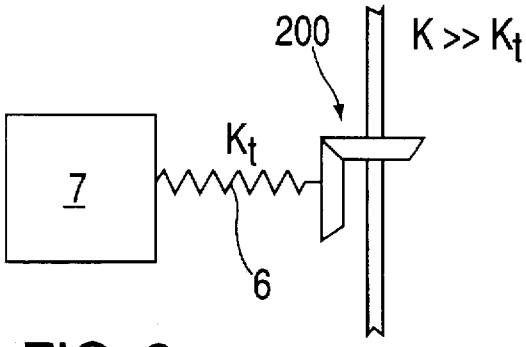
FIGS. 8(*a–c*) show an adjustment member coupling according to FIGS. 4–7 coupled to a printing press component.
Figure 8C:
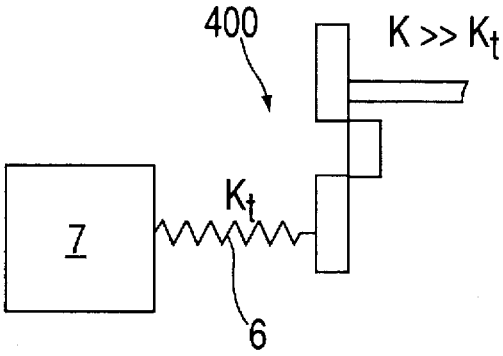
Figure 8B:
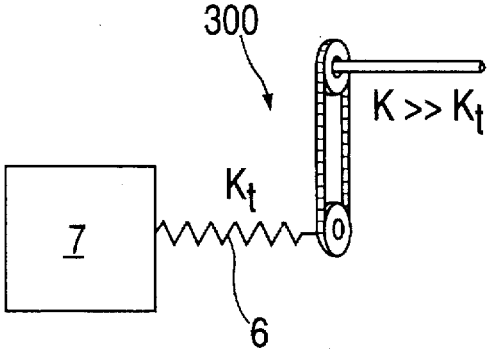

In accordance with the present invention, the coupling 6 can be used to drive any type of press component. For example, the coupling 6 can be used to drive a line shaft component 200 as shown in FIG. 8(*a*), a chain assembly 300 as shown in FIG. 8(*b*), or a gear assembly 400 as shown in FIG. 8(*b*) so long as the coupling 6 is more compliant than the other components in the primary torque path.

The configurations of the adjustment member coupling 6 outlined above allow for tuning of the critical speeds of the printing press by modifying only one component within the primary torque path. Either adjusting or replacing the member 6 allows for shifting critical speeds and, thus, eliminates the need for individual drive arrangements for each family of machines.

While the above embodiments have been described with reference to printing presses, the present invention can also be applied to other processing machines including multi-stage capital equipment such as assembly lines, paper mills, textile mills, and steel mills.

What is claimed is:

1. A mechanism for excluding critical speeds from normal operating ranges comprising:

a processing machine having a predetermined range of normal operating speeds;

at least one drive unit to drive at least one unit of the processing machine, the at least one unit of the processing machine having a predetermined set of torsional stiffnesses; and a single power transmission system linking the at least one drive unit to the at least one unit of the processing machine, the single power transmission system having an adjustment member coupling having an adjustable stiffness, the adjustable stiffness being adjustable to thereby adjust torsionally critical speeds of the processing machine, corresponding to a natural frequency at which the processing machine is excited, out of the predetermined range of operating speeds of the processing machine.

2. The mechanism according to claim 1, wherein the adjustment member coupling includes an adjustable adjustment member.

3. The mechanism according to claim 1, wherein the adjustment member includes a replaceable adjustment member.

4. The mechanism according to claim 1, wherein the adjustment member coupling comprises a driver member, a driven member, and an adjustment member.

5. The mechanism according to claim 4, further comprising:

at least one line shaft for transmitting power to the at least one unit of the processing machine, and wherein the driver member and the driven member drive the line shaft.

6. The mechanism according to claim 4, further comprising:

gears for transmitting power to the at least one unit of a processing machine, and wherein the driver member and the driven member drive the gears.

7. The mechanism according to claim 4, further comprising:

chains for transmitting power to the at least one unit of a processing machine, and wherein the driver member and the driven member drive the chains.

8. The mechanism according to claim 4, further comprising:

belts for transmitting for power to the at least one unit of a processing machine, and wherein the driver member and the driven member drive the belts.

9. The mechanism according to claim 1, wherein the processing machine is a rotary printing press, the rotary printing press being assemblable into a plurality of press configurations, each press configuration having a different stiffness in its respective primary torque path.

10. The mechanism according to claim 1, further comprising:

a plurality of drive units to drive a plurality of units of the processing machine; and and a plurality of power transmission systems linking each drive unit to one unit of the processing machine.

11. The mechanism according to claim 4, wherein:

the driver member includes a protruding part;

the driven member includes a first groove and a second groove, the at least one protruding part being mounted in the second groove; and the adjustment member comprises a support mounted in the first groove.

12. The mechanism according to claim 4, wherein:

the adjustment member comprises at least one torsion bar mounted for a range of angular positions.

13. A mechanism for excluding critical speeds from normal operating ranges comprising:

a processing machine having a predetermined range of normal operating speeds;

at least one drive unit to drive at least one unit of the processing machine, the at least one unit of the processing machine having a predetermined set of torsional stiffnesses;

a single power transmission system linking the at least one drive unit to the at least one unit of the processing machine, the single power transmission system having an adjustment member coupling for adjusting torsionally critical speeds of the processing machine out of the predetermined range of operating speeds of the processing machine;

a driver member and a driven member; and wherein the adjustment member coupling further includes a replaceable torque tube coupled between the driver member and the driven member, a stiffness of the adjustment member coupling being varied by selecting the replaceable torque tube from a set of replaceable torque tubes having different stiffnesses.

14. The mechanism according to claim 13, wherein each replaceable torque tube of the set of replaceable torque tubes is comprised of a material having a different stiffness.

15. The mechanism according to claim 13, wherein each replaceable torque tube of the set of replaceable torque tubes has a different wall thickness.

16. The mechanism according to claim 13, wherein increasing or decreasing the stiffness of the adjustment member coupling shifts the torsionally critical speeds of the processing machine.

17. A mechanism for excluding critical speeds from normal operating ranges comprising:

a processing machine having a predetermined range of normal operating speeds;

at least one drive unit to drive at least one unit of the processing machine, the at least one unit of the processing machine having a predetermined set of torsional stiffnesses;

a single power transmission system linking the at least one drive unit to the at least one unit of the processing machine, the single power transmission system having an adjustment member coupling for adjusting torsionally critical speeds of the processing machine out of the predetermined range of operating speeds of the processing machine;

a driver member and a driven member; and wherein the adjustment member coupling further includes a torque tube coupled between the driver member and the driven member, a stiffness of the adjustment member coupling being varied by changing an axial distance between the driver member and the driven member.

18. A mechanism for excluding critical speeds from normal operating ranges comprising:

a processing machine having a predetermined range of normal operating speeds;

at least one drive unit to drive at least one unit of the processing machine, the at least one unit of the processing machine having a predetermined set of torsional stiffnesses;

a single power transmission system linking the at least one drive unit to the at least one unit of the processing machine, the single power transmission system having an adjustment member coupling for adjusting torsionally critical speeds of the processing machine out of the predetermined range of operating speeds of the processing machine;

a driver member and a driven member; and wherein the adjustment member coupling further includes a plurality of springs of varying stiffnesses, each spring being selectively positionable between the driver member and the driven member to adjust the stiffness of the adjustment member.

19. The mechanism according to claim 18, wherein:

the driver member comprises a protruding part;

the driven member comprises a groove into which the protruding part can be mounted; and the springs are mounted between the protruding part and the groove.

20. A mechanism for excluding critical speeds from normal operating ranges comprising:

a processing machine having a predetermined range of normal operating speeds;

at least one drive unit to drive at least one unit of the processing machine, the at least one unit of the processing machine having a predetermined set of torsional stiffnesses;

a single power transmission system linking the at least one drive unit to the at least one unit of the processing machine, the single power transmission system having an adjustment member coupling for adjusting torsionally critical speeds of the processing machine out of the predetermined range of operating speeds of the processing machine;

a driver member and a driven member; and wherein the adjustment member coupling further includes a plurality of replaceable spring members, each replaceable spring member being selectively mountable in the driven member to adjust the torsionally critical speeds of the drive unit.

21. The mechanism according to claim 20, wherein the replaceable spring member is mounted within an opening in the driven member.

22. The mechanism according to claim 21, wherein the replaceable spring member is held within the opening of the driven member by a fastening device.

23. The mechanism according to claim 22, wherein at least one of the plurality of replaceable spring members is made of a material having a different elastic modulus than at least one other of the plurality of replaceable spring members.

* * * * *